US010837175B2

(12) United States Patent
Kim et al.

(10) Patent No.: US 10,837,175 B2
(45) Date of Patent: Nov. 17, 2020

(54) TEXTILE-REINFORCED CONCRETE STRUCTURE USING TEXTILE GRID FIXING APPARATUS AND CONSTRUCTION METHOD FOR THE SAME

(71) Applicant: KOREA INSTITUTE OF CIVIL ENGINEERING AND BUILDING TECHNOLOGY, Gyeonggi-Do (KR)

(72) Inventors: Hyeong Yeol Kim, Gyeonggi-do (KR); Kyung Taek Koh, Gyeonggi-do (KR); Gum Sung Ryu, Gyeonggi-do (KR)

(73) Assignee: KOREA INSTITUTE OF CIVIL ENGINEERING AND BUILDING TECHNOLOGY, Gyeonggi-do (KR)

( * ) Notice: Subject to any disclaimer, the term of this patent is extended or adjusted under 35 U.S.C. 154(b) by 22 days.

(21) Appl. No.: 16/174,275

(22) Filed: Oct. 29, 2018

(65) Prior Publication Data

US 2020/0040580 A1 Feb. 6, 2020

(30) Foreign Application Priority Data

Aug. 3, 2018 (KR) ..... 10-2018-0090642

(51) Int. Cl.
*E04C 5/07* (2006.01)
*E04B 2/84* (2006.01)
(Continued)

(52) U.S. Cl.
CPC ..... *E04C 5/073* (2013.01); *E04B 2/84* (2013.01); *E04B 5/32* (2013.01); *E04C 5/168* (2013.01); *E04B 2103/02* (2013.01); *E04C 5/01* (2013.01)

(58) Field of Classification Search
CPC .... E04B 1/167; E04B 2/8635; E04B 2103/02; E04B 2/84; E04B 5/32; E04C 2/044;
(Continued)

(56) References Cited

U.S. PATENT DOCUMENTS 938,662 A * 11/1909 Graham ..... E04B 2/84 52/378
1,070,921 A * 8/1913 Salteil ..... E04C 5/168 52/686
(Continued)

FOREIGN PATENT DOCUMENTS

CA 2487000 A1 * 5/2005 ..... E04B 2/8647
DE 102012004785 A1 * 9/2013 ..... E04C 5/20
(Continued)

*Primary Examiner* — Ryan D Kwiecinski
*Assistant Examiner* — Matthew J Gitlin
(74) *Attorney, Agent, or Firm* — JCIPRNET

(57) ABSTRACT

Provided are a textile-reinforced concrete structure using a textile grid fixing device and a construction method therefor. A textile grid is precisely disposed at a predetermined position between a mold and a main reinforcing bar using a textile grid fixing device so as to be prevented from being moved by a pouring pressure when concrete is poured, and thus a textile-reinforced concrete structure can be precisely constructed. The textile grid fixing device is fixed to one side of the mold, and the textile-reinforced concrete structure is constructed using the textile grid fixing device such that fine cracks are suppressed from being generated on a surface of concrete. Further, a surface of a concrete structure is protected from an external environment when the textile-reinforced concrete structure is constructed so that a covering thickness of concrete can be reduced, and thus, the textile-reinforced concrete structure can be economically constructed.

11 Claims, 12 Drawing Sheets

(51) Int. Cl.
*E04C 5/16* (2006.01)
*E04B 5/32* (2006.01)
*E04C 5/01* (2006.01)

(58) Field of Classification Search
CPC . E04C 5/01; E04C 5/073; E04C 5/168; E04G 9/10; E04G 9/02
See application file for complete search history.

(56) References Cited

U.S. PATENT DOCUMENTS 3,693,310 A * 9/1972 Middleton ..... E04C 5/168 52/685
4,031,685 A * 6/1977 Heinz ..... B21F 27/125 52/649.4
4,060,954 A * 12/1977 Liuzza ..... E04C 5/168 52/677
4,270,583 A * 6/1981 Tolliver ..... B21F 27/121 140/107
4,346,135 A * 8/1982 Arnheiter ..... E04C 5/073 428/212
4,819,395 A * 4/1989 Sugita ..... E04C 5/07 156/181
4,945,704 A * 8/1990 Brown, Jr. ..... E04C 5/168 52/699
5,996,297 A * 12/1999 Keith ..... E04C 2/044 411/456
6,202,375 B1 * 3/2001 Kleinschmidt ..... E04C 2/044 52/281
6,282,860 B1 * 9/2001 Ramirez ..... E04C 5/167 52/677
2004/0206030 A1 * 10/2004 Juedes ..... E04C 5/08 52/384
2008/0245022 A1 * 10/2008 Choi ..... E04B 1/4121 52/653.1
2011/0214381 A1 * 9/2011 Alfonso ..... E04C 5/168 52/685
2013/0074433 A1 * 3/2013 Ciuperca ..... E04B 1/355 52/426
2014/0083044 A1 * 3/2014 Krumb ..... E04B 5/29 52/699
2014/0115995 A1 * 5/2014 Baldoni ..... E04C 5/168 52/687
2014/0260034 A1 * 9/2014 Ciuperca ..... E04C 2/296 52/405.3
2015/0132533 A1 * 5/2015 Karle ..... E04C 2/06 428/107
2016/0053492 A1 * 2/2016 Leinenbach ..... E04G 21/12 52/223.14
2018/0010348 A1 * 1/2018 Crestani ..... E04B 2/84
2018/0071949 A1 * 3/2018 Giles ..... B33Y 10/00
2018/0371657 A1 * 12/2018 Mikulecky ..... D04H 3/04
2019/0136389 A1 * 5/2019 Kim ..... C23F 13/14
2019/0136551 A1 * 5/2019 Kim ..... E04B 1/167
2019/0153728 A1 * 5/2019 Kim ..... E04C 2/06

FOREIGN PATENT DOCUMENTS

DE 102012025629 A1 * 1/2014 ..... E04C 5/20
DE 102013100053 A1 * 7/2014 ..... E04F 13/148
EP 1318247 A1 * 6/2003 ..... C23F 13/16
EP 3258029 12/2017
EP 3321444 A1 * 5/2018 ..... E04C 5/168
JP 6129835 5/2017
JP 2017160780 9/2017
KR 100454021 10/2004
KR 101434523 9/2014
KR 101612800 4/2016
KR 101759796 7/2017

* cited by examiner

TEXTILE-REINFORCED CONCRETE STRUCTURE USING TEXTILE GRID FIXING APPARATUS AND CONSTRUCTION METHOD FOR THE SAME

CROSS-REFERENCE TO RELATED APPLICATION

This application claims priority to and the benefit of Korean Patent Application No. 2018-0090642, filed on Aug. 3, 2018, the disclosure of which is incorporated herein by reference in its entirety.

BACKGROUND

1. Field of the Invention

The present invention relates to a textile-reinforced concrete structure using a textile grid fixing apparatus, and more specifically, to a textile-reinforced concrete structure using a textile grid fixing apparatus which fixes a textile grid reinforcement material disposed between a mold and a reinforcing bar when a reinforced concrete structure is constructed, and a construction method for the same.

2. Discussion of Related Art

Generally, reinforced concrete in which concrete and reinforcing bar are combined is most widely used for building and civil engineering structures and is known as a structure material which is economical and has high durability. Further, the reinforced concrete is known as a composite material with a function which is optimal in terms of long-term durability as well as mechanical strength. However, according to various recently conducted research and field investigations, it is reported that durability of the reinforced concrete may be degraded due to corrosion of a reinforcing bar so that a severe problem is caused throughout the reinforced concrete structure.

The main factor that degrades durability of a reinforced concrete structure is corrosion of an embedded reinforcing bar, and the main factor that causes corrosion of the embedded reinforcing bar may be permeation of chlorine ion and carbon dioxide. When the reinforcing bar corrodes, corrosion products are formed on a surface of the embedded reinforcing bar to cause cracks and delamination of concrete, and the cracks and delamination allow an external harmful factor to easily permeate the concrete, and thus corrosion of the reinforcing bar is accelerated.

Therefore, safety and durability of the reinforced concrete structure are highly degraded, and in severe cases, the structure may collapse. Further, when the reinforced concrete structure is already damaged, a work of repairing and reinforcing the reinforced concrete structure is very difficult, limited, and costly.

Specifically, the degradation of the reinforced concrete structure is affected by quality of used concrete and reinforcing bars, an environmental factor, a physical factor, and the like, and particularly, mainly by corrosion of a reinforcing bar embedded in the concrete. In particular, when salinity in the seawater or calcium chloride used to melt snow on a road in winter time permeates the concrete when a reinforced concrete structure is positioned in a marine environment, the reinforcing bar embedded in the concrete corrodes easily, and the corroding reinforcing bar expands so as to generate fine cracks on the concrete.

FIG. 1 is an example view illustrating a concrete structure according to a conventional art.

In the case of the concrete structure according to the conventional art, as shown in FIG. 1, fine cracks 30 are generated on a surface of the concrete structure during a curing process after construction or when in use, and when water, chloride, or the like permeates a concrete structure 10 through the crack 30, a defect of a cross section is caused due to corrosion of a reinforcing bar 20, and thus, safety of the concrete structure 10 is degraded. Further, when a cross section of the concrete structure 10 is delaminated due to a freezing and melting action and a corrosion expansion pressure, the cross section is degraded, and corrosion of reinforcing bar is accelerated.

FIGS. 2A and 2B are example views illustrating a textile-reinforced concrete structure.

As shown in FIG. 2A, to fundamentally solve a problem of degradation of a reinforced concrete structure caused by corrosion of a reinforcing bar, textile-reinforced concrete using a textile grid reinforcement material 40 woven or knitted in a grid shape from a high strength fabric, such as a carbon fiber, an aramid fabric, a glass fabric, or the like, has recently been constructed. According to a research result, a diameter of the textile grid reinforcement material 40 is generally less than that of a reinforcing bar, but the textile grid reinforcement material 40 is densely arranged, and thus fine cracks of the reinforced concrete structure 10 can be suppressed when compared to a reinforcing bar.

Therefore, as shown in FIG. 2A, a two-dimensional or three-dimensional textile grid 40 woven formed from a high strength fabric is disposed between a surface of a structure, which is in contact with an external environment, and a main reinforcing bar, which is arranged for a purpose of structural reinforcement (a portion corresponding to a covering thickness), and concrete is poured and cured, and thus fine cracks in the reinforced concrete structure 10 can be suppressed as much as possible. Therefore, the degradation of the structure caused by corrosion of the main reinforcing bar and fine cracks is prevented, and thus durability of the reinforced concrete structure 10 can be increased, and service lifetime can be increased.

As shown in FIG. 2B, the textile-reinforced concrete structure suppresses fine cracks from being generated on a surface of concrete during a curing process after construction or when in use and prevents water, chloride, and the like from permeating from a surface thereof into the concrete structure 10, thereby increasing service lifetime of the concrete structure and safety of the structure. Recently, a textile grid reinforcement material, which is manufactured by preparing a textile grid fabric by weaving or knitting a lattice-shaped fabric formed from a high strength fabric, covering a surface of the fabric with a resin coating solution, such as polyvinyl chloride, pitch, acryl, latex, rubber-based resin, or the like, and performing high-temperature thermal treatment, is effectively used to newly construct and reinforce a concrete structure as the textile grid reinforcement material 40.

Further, the textile grid reinforcement material 40 uses a high strength fabric in order to have tensile strength greater than a plastic grid and tensile strain less than the plastic grid so as to have structural material properties which are excellent for constructing and reinforcing a structure. However, a method of effectively fixing the textile grid reinforcement material 40 between a reinforcing bar 20 and a mold when the textile-reinforced concrete structure 10 is constructed is not yet provided.

Meanwhile, the textile-reinforced concrete is used for constructing a building and a civil engineering structure internationally, but a method of effectively fixing the textile grid when the textile-reinforced concrete structure is constructed is not provided, and a precast concrete product in which a textile grid is fixed to a mold is pre-produced in a factory.

Further, according to the conventional art, a spacer or a chair produced for arrangement of a reinforcing bar is applied as a textile grid fixing device. However, since the textile grid fixing device is invented for a purpose of maintaining a space between the reinforcing bar and the mold, the textile grid fixing device may not be fixed to the mold, and thus the textile grid fixing device cannot support a pouring pressure when concrete is poured, and a textile grid cannot be precisely disposed and constructed.

As a related art associated with fixing the textile grid, Korean Registration Patent No. 10-1612800 discloses an invention titled "Method of Repairing and Reinforcing Tunnel, Bridge, Cavity, and Reinforced Concrete Structure Using a Lattice-Shaped Fabric Mesh and Cement Matrix as a Reinforcement Material for Increasing Load Carrying Capacity and Fire Resistance." Specifically, the invention relates to a method of improving repair, reinforcement, and earthquake resistance of a structure using a lattice-shaped mesh and cement matrix with increased attachment force and fire resistance, and a method of fixing a lattice-shaped fabric mesh to conventional concrete using a rivet-shaped temporary fixing unit is suggested.

Further, as another related art associated with fixing a textile grid, Korean Registration Patent No. 10-1434523 discloses an invention titled "Method of Repairing and Seismic-Reinforcing a Concrete Structure Using Inorganic-Based Cement Matrix and Coated Fabric Grid." The invention relates to a method for performing repair on and adding earthquake-resistance to a concrete structure with a fabric grid and inorganic-based cement matrix, and a rivet-shaped fixing unit is suggested therein.

Further, as another conventional art associated with fixing a textile grid, Korean Registration Patent No. 10-454021 discloses an invention titled "Method of Repairing and Reinforcing a Concrete Structure using a Hybrid Structure," and a method of fixing a grid to a conventional concrete using a fastener with an anchor fastening hole is suggested therein.

However, the above-described fixing device relates to a method of pouring mortar or concrete on a textile fixed to a cross section of conventional concrete, and thus the fixing device cannot be applied between a mold and an arranged reinforcing bar when a structure is newly constructed.

PRIOR ART LITERATURE (Patent Document 0001) Korean Registration Patent No. 10-1759796 (Filed on Nov. 16, 2015), Title of Invention: "Apparatus of Manufacturing Precast Concrete."

(Patent Document 0002) Korean Registration Patent No. 10-1612800 (Filed on Dec. 24, 2015), Title of Invention: "Method of Repairing and Reinforcing Tunnel, Bridge, Cavity, and Reinforced Concrete Structure using a Lattice shaped-Fabric Mesh and Cement Matrix as a Reinforcement Material for Increasing Load Carrying Capacity and Fire Resistance."

(Patent Document 0003) Japanese Registration Patent No. 6,129,835 (Filed on Aug. 6, 2012), Title of Invention: "Method of Reinforcing Building Member."

(Patent Document 0004) Korean Registration Patent No. 10-454021 (Filed on Oct. 28, 2002), Title of Invention: "Method of Repairing and Reinforcing a Concrete Structure using a Hybrid Structure."

(Patent Document 0005) Korean Registration Patent No. 10-1434523 (Filed on Nov. 29, 2013), Title of Invention: "Method of Repairing and Seismic-Reinforcing a Concrete Structure using Inorganic-Based Cement Matrix and Coated Fabric Grid."

(Patent Document 0006) Japanese Patent Application Laid-Open No. 2017-160780 (Published on Sep. 14, 2017), Title of Invention: "Method of Reinforcing a Building Member."

SUMMARY OF THE INVENTION

The present invention is directed to providing a textile-reinforced concrete structure using a textile grid fixing device, which precisely disposes a textile grid at a predetermined position between a mold and a main reinforcing bar using a textile grid fixing device so as to prevent a tensile grid from being moved by a pouring pressure when concrete is poured, and a construction method thereof.

The present invention is directed to providing a textile-reinforced concrete structure using a textile grid fixing device which allows a textile grid fixing device to be fixed to one side of a mold and allows a textile-reinforced concrete structure to be constructed using a textile grid fixing device so as to suppress fine cracks from being generated on a surface of concrete and prevent water, chloride, and the like from permeating a concrete structure, and a construction method thereof.

The present invention is directed to providing a textile-reinforced concrete structure using a textile grid fixing device which allows a surface of a concrete structure to be protected from an external environment when the textile-reinforced concrete structure is constructed so as to reduce a covering thickness of concrete, and a construction method thereof.

According to an aspect of the present invention, there is provided a textile-reinforced concrete structure using a textile grid fixing device which includes poured concrete poured in a mold to form a textile-reinforced concrete structure, a reinforcing bar assembled and disposed in the mold, a plurality of textile grids installed between the reinforcing bar and the mold, and a textile grid fixing device including a head, a cover, a supporting part, and an anchor, wherein the plurality of textile grids are fixedly disposed on the head, the anchor is fixed to one side of the mold, and the textile grid fixing device is fixed to one side of the mold so that the textile grids are fixed between the reinforcing bar and the mold, the textile grids are fixedly disposed on the textile grid fixing device, the anchor of the textile grid fixing device is cut or disassembled, and the mold is removed so that a cross section of the textile-reinforced concrete structure is completed.

The textile grid fixing device may include a head including a grip groove and a head fastening hole, wherein the plurality of textile grids may be fixedly inserted into the grip groove, a cover including a fastening anchor and a grid insertion groove, wherein the fastening anchor may be fastened to a head fastening hole while the textile grids are disposed between the grip groove and the grid insertion groove, a supporting part fastened to a lower portion of the head to function as a support, and an anchor having one sides fixed to the mold and the other sides fastened to a lower portion of the supporting part and cut or disassembled after the concrete is cured.

The textile grid fixing device may further include an expansion joint coupled between the head and the supporting part so that a height of the textile grid fixing device is adjustable according to spatial needs.

The anchor may be a bolt-type anchor or a wedge anchor.

The bolt-type anchor may have a bolt thread formed on one side thereof and a fixing tab formed on the other side thereof so that the textile grid fixing device is fixed to one side of the mold in a bolt manner.

The wedge-type anchor may have a bolt thread formed on one side thereof and a wedge groove which is formed on the other side thereof and into which a wedge is inserted so that the textile grid fixing device is fixed to one side of the mold in a wedge manner.

The grip groove formed in the head may be formed to have a depth sufficient for two textile grids to be simultaneously inserted thereinto.

According to another aspect of the present invention, there is provided a method of constructing a textile-reinforced concrete structure using a textile grid fixing device which includes the steps of a) installing a textile grid fixing device, including a head, a cover, a supporting part, and an anchor, in a mold, b) fixedly disposing a textile grid on the textile grid fixing device, c) assembling and disposing a reinforcing bar in the mold for a textile-reinforced concrete structure, d) pouring poured concrete in the mold, e) removing or disassembling the anchor of the textile grid fixing device after the poured concrete is cured and removing the mold, and f) completing a cross section of a textile-reinforced concrete structure, wherein the textile grid fixing device is fixed to one side of the mold so that the plurality of textile grids are fixed between the reinforcing bar and the mold, the textile grids are fixedly disposed on the textile grid fixing device, the anchor of the textile grid fixing device is cut or disassembled, and the mold is removed so that a cross section of the textile-reinforced concrete structure is completed.

The textile grid fixing device in the step a) may be installed on the mold and a connection part between the molds or in a through hole formed at a predetermined position of the mold.

The textile grid fixing device may be minimally formed to support only one end portion of the textile grid and the connection part when the mold and the anchor is directly fastened to each other while a horizontal member, such as a slab, is constructed.

The textile-reinforced concrete structure may be a concrete structure with a curved surface including tunnel lining or a wastewater structure, wherein the textile grid fixing device may be fixed to the mold formed with a curved surface, the textile grid may be fixedly disposed to correspond to the mold formed with the curved surface, and the textile-reinforced concrete structure may be precisely constructed.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings.

DETAILED DESCRIPTION OF EXEMPLARY EMBODIMENTS

Figure 1:
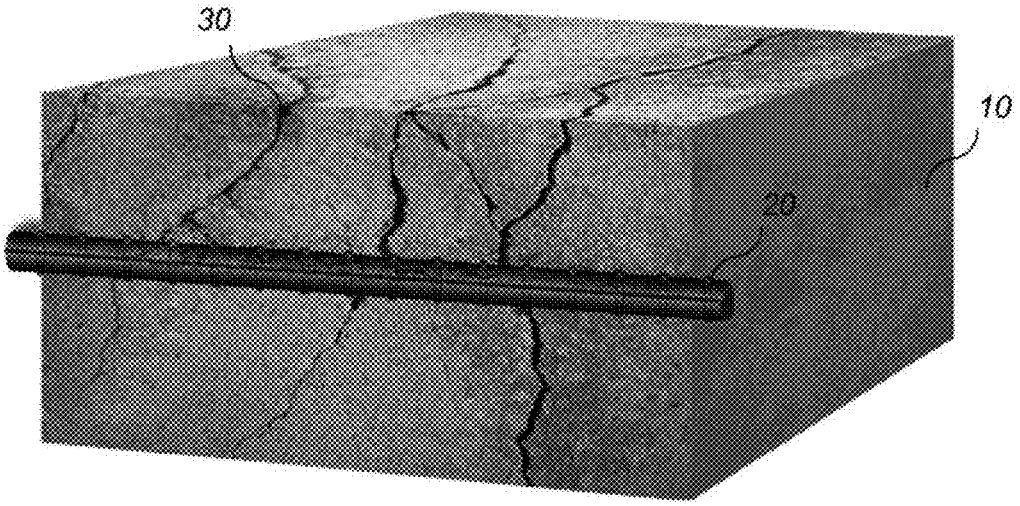
FIG. 1 is an example view illustrating a concrete structure according to a conventional art.
Figure 2A:
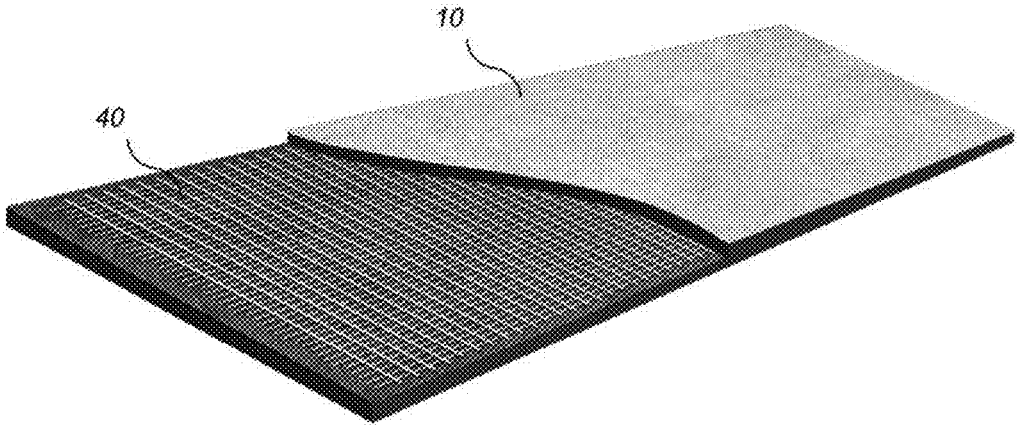
FIGS. 2A and 2B are example views illustrating a textile-reinforced concrete structure.
Figure 2B:
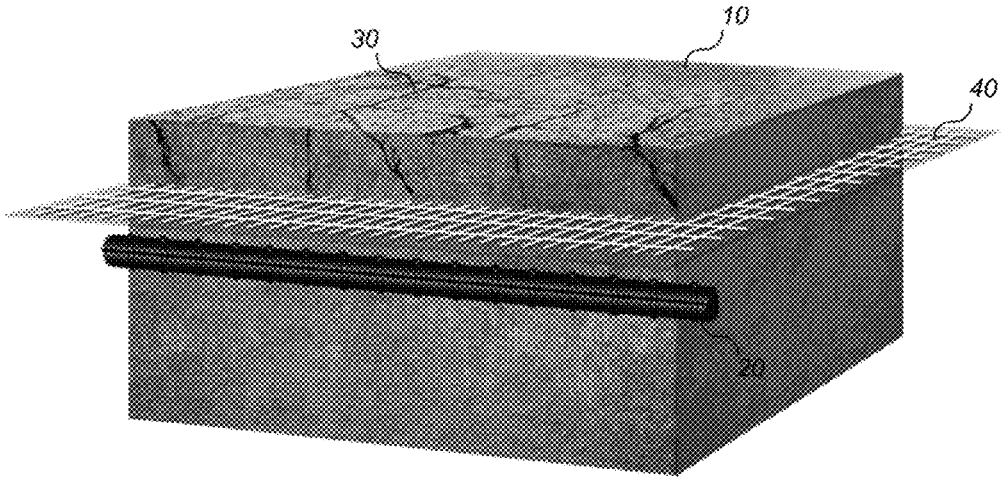

Hereinafter, embodiments that are easily performed by those skilled in the art will be described in detail with reference to the accompanying drawings. However, the embodiments of the present invention may be implemented in several different forms and are not limited to the embodiments described herein. In addition, parts irrelevant to description will be omitted in the drawings to clearly explain the embodiments of the present invention. Similar parts are denoted by similar reference numerals throughout this specification.

Throughout the specification, when a portion "includes" an element, the portion may include the element or another element may be further included therein, unless otherwise described.

[Textile Grid Fixing Device]

Figure 3A:
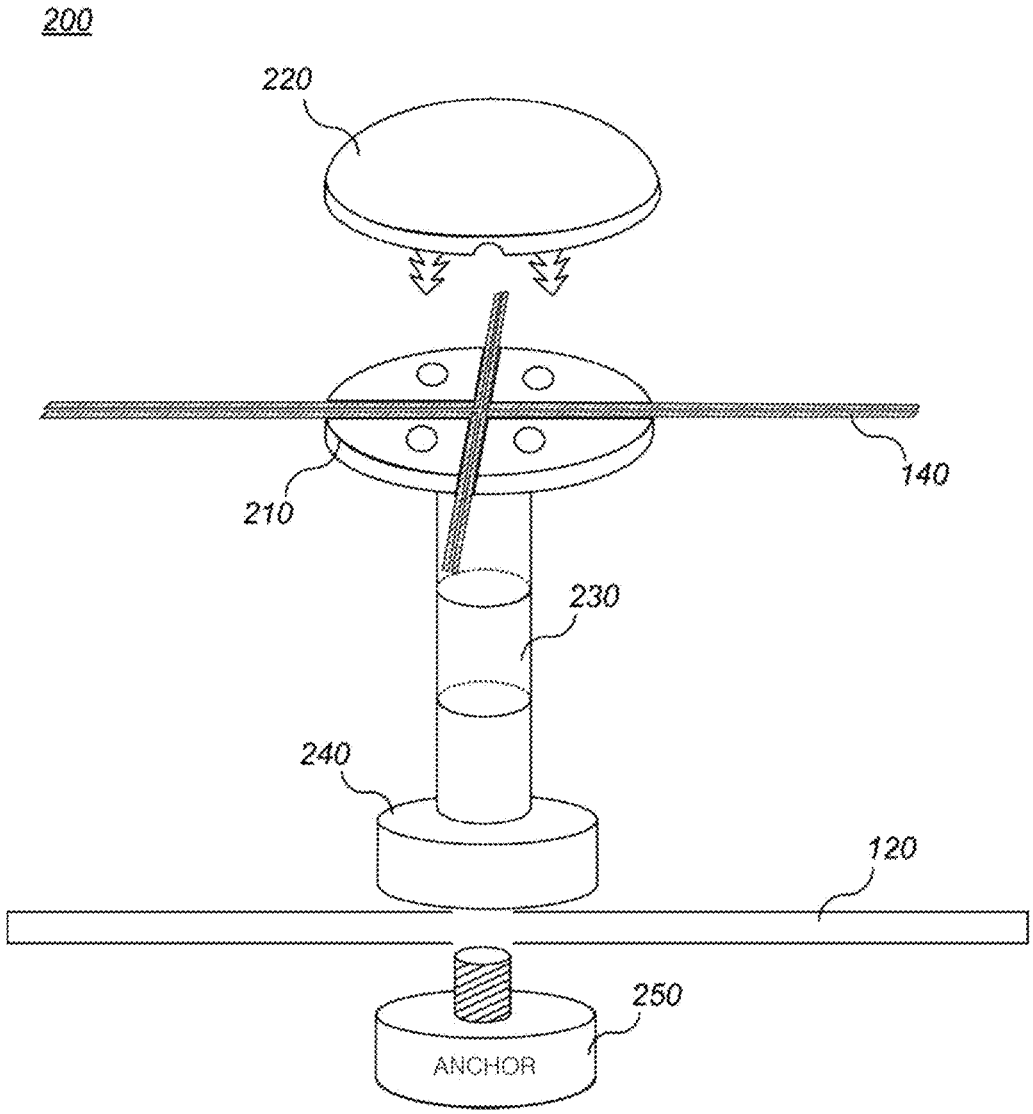
FIGS. 3A and 3B are example views for schematically describing a textile grid which is fixed to a mold using a bolt-type anchor in a textile grid fixing device according to one embodiment of the present invention.
Figure 3B:
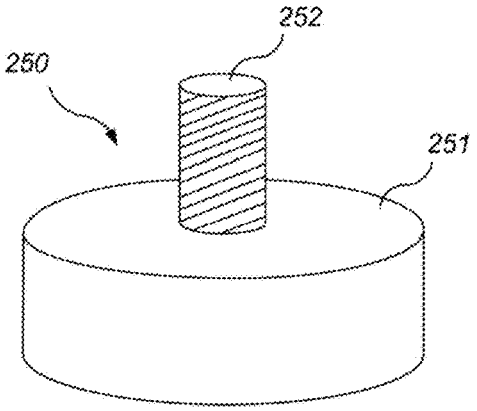
Figure 4A:
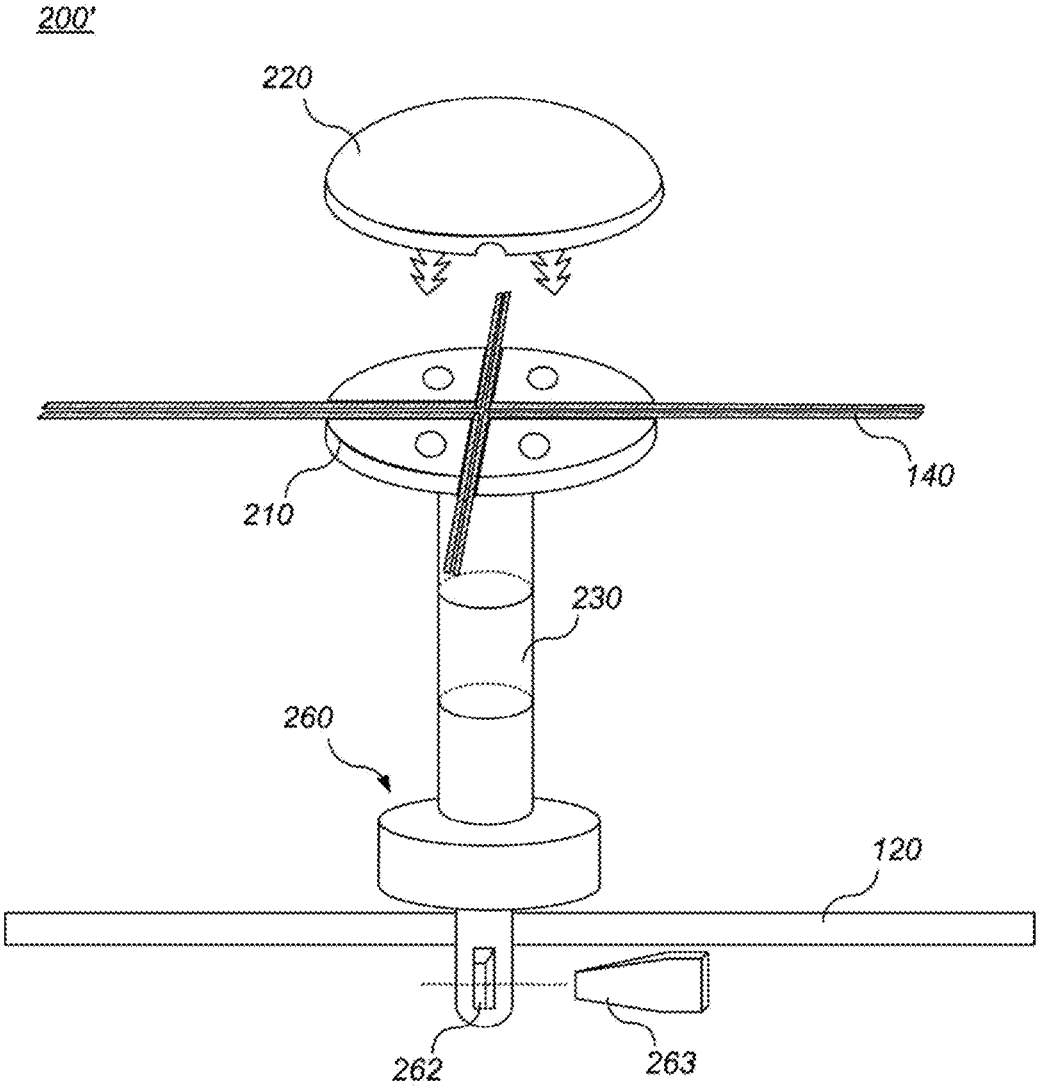
FIGS. 4A and 4B are example views for schematically describing a textile grid which is fixed to a mold using a wedge-type anchor in the textile grid fixing device according to one embodiment of the present invention.
Figure 4B:
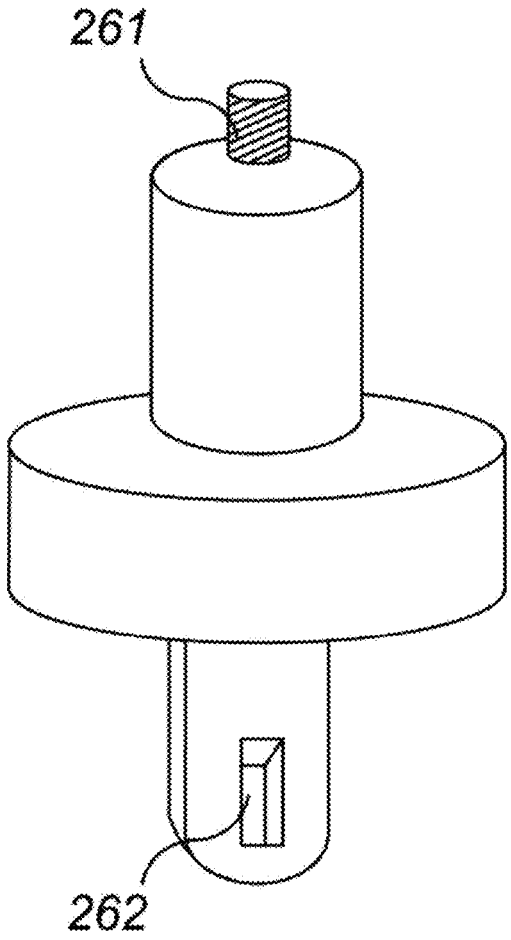
Figure 5:
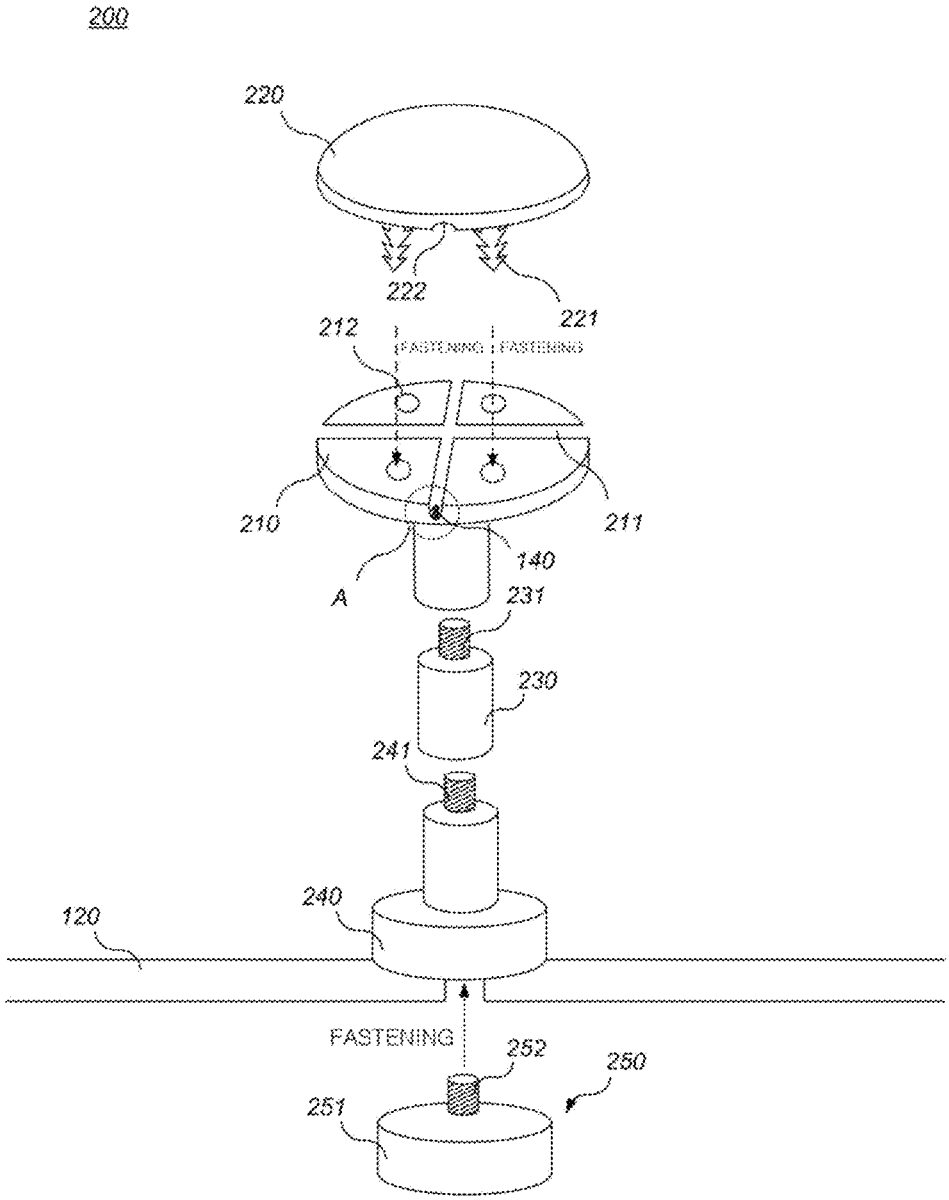
FIG. 5 is an exploded assembly view of a textile grid fixing device using a bolt-type anchor according to one embodiment of the present invention.

FIGS. 3A and 3B are example views for schematically describing a textile grid which is fixed to a mold using a bolt-type anchor in a textile grid fixing device according to one embodiment of the present invention, FIGS. 4A and 4B are example views for schematically describing a textile grid which is fixed to a mold using a wedge-type anchor in the textile grid fixing device according to one embodiment of the present invention, and FIG. 5 is an exploded assembly view of a textile grid fixing device using a bolt-type anchor according to one embodiment of the present invention.

Referring to FIGS. 3 to 5, a textile grid fixing device 200 according to one embodiment of the present invention includes a head 210, a cover 220, an expansion joint 230, a supporting part 240, and an anchor 250 or 260.

As shown in FIG. 5, the head 210 includes a cross-shaped grip groove 211 and a head fastening hole 212, and a plurality of textile grids 140 are inserted into the grip groove 211. In this case, referring to a symbol A in FIG. 5, it is preferable that the grip groove 211 formed in the head 210 is formed to have a depth sufficient for two textile grids 140 to be simultaneously inserted. That is, a depth of the grip groove 211 formed in the head 210 is sufficient for two textile grids 140 to be inserted thereinto. The textile grids 140 are manufactured of a predetermined material to be manufactured and treated, and thus, when the textile grids 140 have a lap joint, both textile grids 140 are simultaneously inserted into the grip groove 211.

As shown in FIG. 5, the cover 220 includes a fastening anchor 221 corresponding to the head fastening hole 212 and includes a grid insertion groove 222 into which the textile grids 140 are inserted. The fastening anchor 221 is fastened to the head fastening hole 212 while the textile grid 140 is disposed between the grip groove 211 and the grid insertion groove 222.

As shown in FIG. 5, the supporting part 240 is fastened to a lower portion of the head 210 through a support bolt thread 241 and functions as a support.

As shown in FIG. 5, the expansion joint 230 is coupled between the head 210 and the supporting part 240 through a bolt thread 231 so that a height of the textile grid fixing device 200 is adjustable. That is, since the textile-reinforced concrete structure according to one embodiment of the present invention may be applied to construction of various structures, a height of the textile grid fixing device 200 is required to be differently applied according to structural and spatial needs, and thus the textile grid fixing device 200 may be assembled and applied to have various heights by being applied with combination of the expansion joints 230 with various lengths.

The anchor 250 or 260 has one sides fixed to the mold 120 and the other sides fastened to a lower portion of the supporting part 240 and is cut or unfastened after concrete is cured. In this case, the anchor 250 or 260 may be one of two kinds of a bolt-type anchor 250 and a wedge-type anchor 260. As shown in FIG. 3B, the anchor 250 or 260 may be the bolt-type anchor 250 having a bolt thread 252 formed on one side thereof and a fixing tap 251 formed on the other side thereof to fix the textile grid fixing device 200 to one side of the mold 120 in a bolt manner, or as shown in FIG. 4A, may be the wedge-type anchor 260 having wedge grooves 262 formed in one side and the other side thereof so that a wedge 263 may be inserted thereinto to fix the textile grid fixing device 200 to one side of the mold 120. As shown in FIG. 4B, the wedge-type anchor 260 may be integrally formed with the above-described supporting part 240.

It is preferable that each part of the textile grid fixing device 200 according to one embodiment of the present invention is manufactured of a high strength and noncorrosive material, such as nonferrous metal, high strength plastic, a composite material, or the like.

Figure 6:
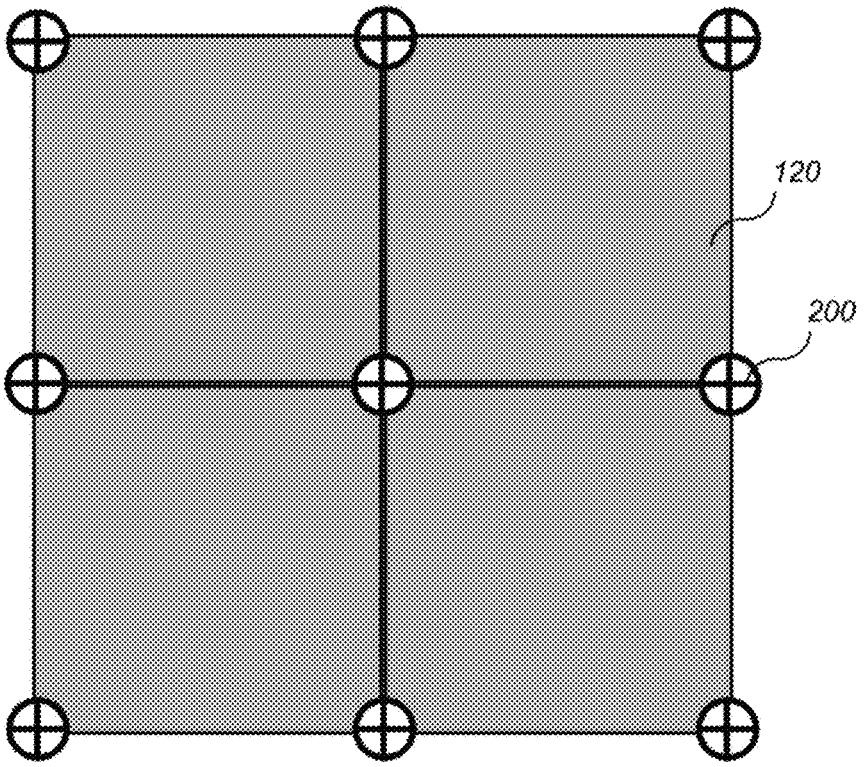
FIG. 6 is a plan view illustrating the textile grid fixing device according to one embodiment of the present invention, which is fixed to a mold.
Figure 7:
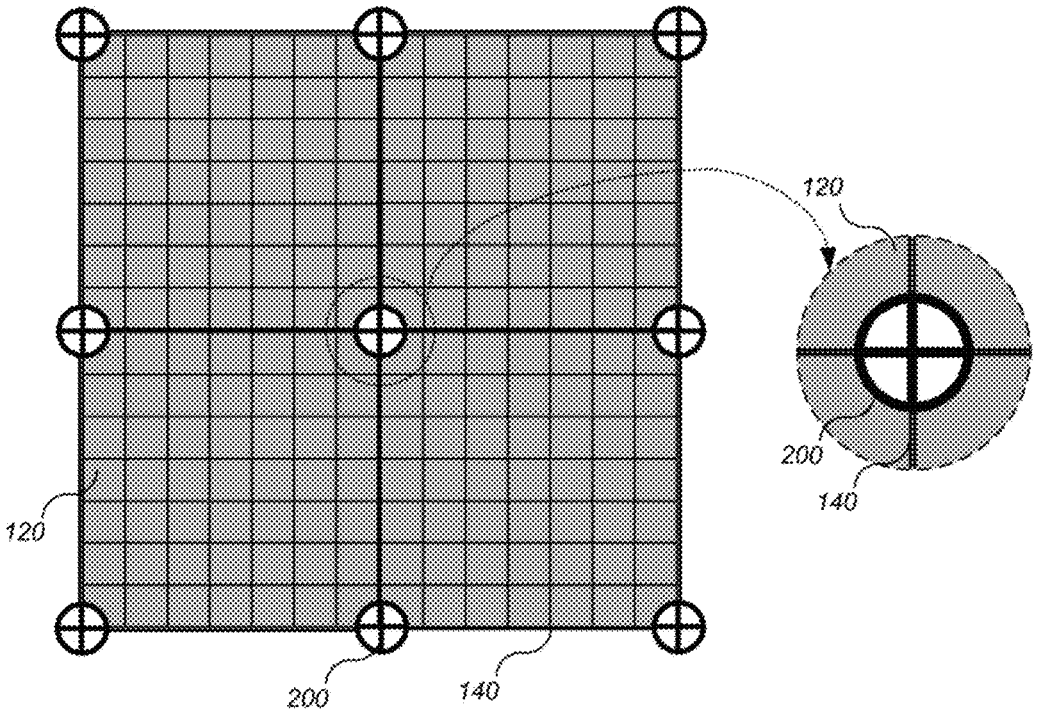
FIG. 7 is a plan view illustrating a textile grid which is fixed to the textile grid fixing device according to one embodiment of the present invention.

FIG. 6 is a plan view illustrating the textile grid fixing device according to one embodiment of the present invention, which is fixed to a mold, and FIG. 7 is a plan view illustrating a textile grid which is fixed to the textile grid fixing device according to one embodiment of the present invention.

As shown in FIG. 6, the textile grid fixing device 200 according to one embodiment of the present invention may be installed on various molds 120, such as Euroform, a plywood form, and the like, and a connection part between the molds 120, and the textile grid fixing device 200 may be installed in a through hole formed at a predetermined position of the mold 120.

Further, as shown in FIG. 7, when the textile grid fixing device 200 is mounted on the mold 120, the textile grids 140 are fixed to the textile grid fixing device 200, and the textile grids 140 are inserted into a grip groove 211 of a head 210 while the textile grid fixing device 200 moves in order to accurately connect the textile grid fixing device 200 at a predetermined position.

The textile grid fixing device 200 according to one embodiment of the present invention may also be applied to construction of a horizontal member such as a slab or the like. For example, as shown in FIG. 7, the textile grid fixing device 200 directly fastened using a mold and an anchor when the horizontal member is formed may minimally formed to support only one end portion of the textile grid 140 and a connection part. In this case, a portion, except the anchor 250 or 260, of the textile grid fixing device 200 according to one embodiment of the present invention may be applied to a portion that does not need to be directly connected with a mold as a textile chair to support a pouring pressure of the remaining textile grids which are not supported.

Further, even when a structure with a curved surface, such as tunnel lining, wastewater structure, or the like, is constructed, the textile grid fixing device 200 according to one embodiment of the present invention may be precisely constructed by being fixed to a mold and fixedly disposing the textile grid 140 to be matched with the curved mold.

[Textile-Reinforced Concrete Structure Using Textile Grid Fixing Device]

The textile grid fixing device 200 according to one embodiment of the present invention may be applied to construction of various concrete structures or members, such as a wall (a vertical member), a slab (a horizontal member), a circular member, and the like, but will be described with reference to FIG. 8 on the basis of a wall for convenience of explanation.

Figure 8:
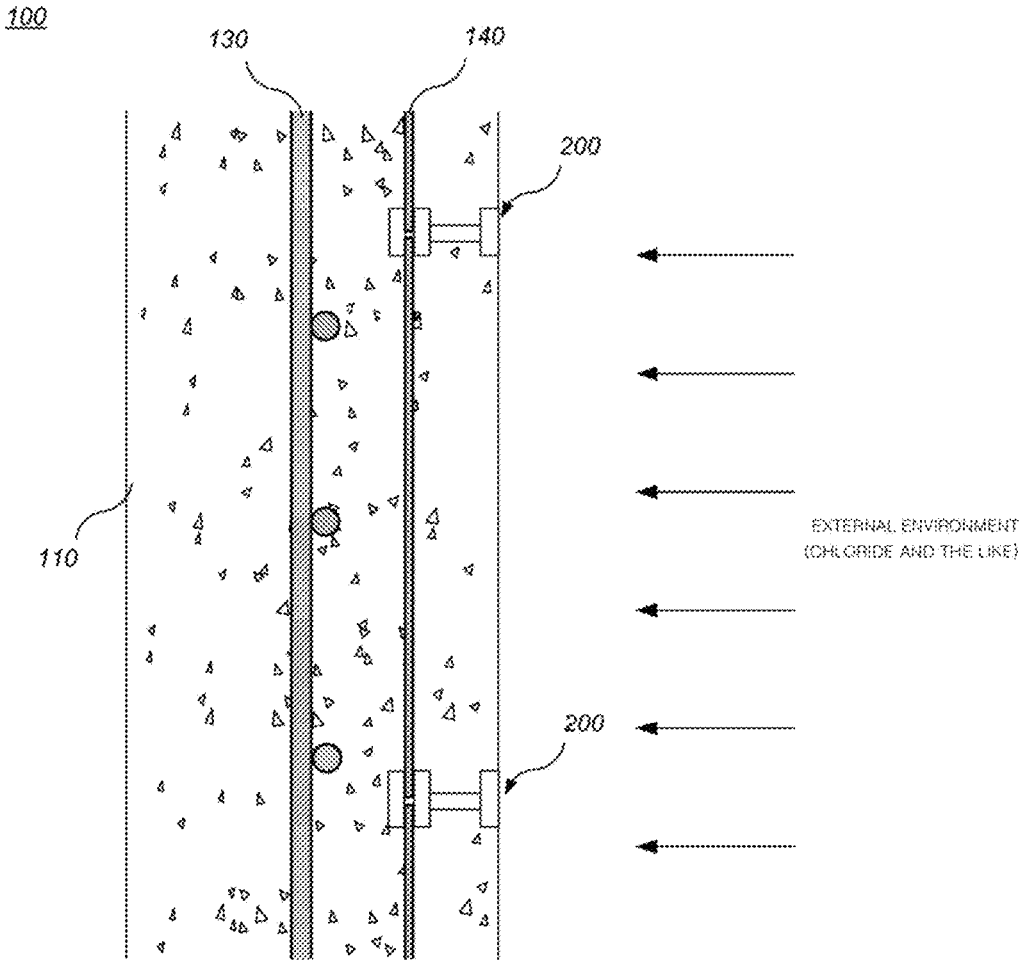
FIG. 8 is a side view illustrating a textile-reinforced concrete structure using a textile grid fixing device according to one embodiment of the present invention.

FIG. 8 is a side view illustrating a textile-reinforced concrete structure using a textile grid fixing device according to one embodiment of the present invention, and shows a cross section of the textile-reinforced concrete structure 100 is completed when curing of the poured concrete 110 is completed, the anchor 250 or 260 of the textile grid fixing device 200 is removed or disassembled, and the mold 120 is removed.

Referring to FIG. 8, the textile-reinforced concrete structure 100 using a textile grid fixing device according to one embodiment of the present invention includes poured concrete 110, a mold 120, a reinforcing bar 130, a textile grid 140, and a textile grid fixing device 200.

The poured concrete 110 is poured in the mold 120 to form the textile-reinforced concrete structure 100, and the reinforcing bar 130, which is transverse and longitudinal embedded reinforcing bars, is assembled and disposed in the mold 120.

The textile grids 140 are installed between the reinforcing bar 130 and the mold 120, and the plurality of textile grids 140 are fixed and connected by the textile grid fixing device 200.

The textile grid fixing device 200 includes a head 210, a cover 220, a supporting part 240, and anchor 250 or 260, wherein the plurality of textile grids 140 are fixedly disposed on the head 210, and the anchor 250 or 260 is fixed to one side of the mold 120. In this case, the textile grid fixing device 200 is fixed to one side of the mold 120 so that the textile grid 140 is fixed between the reinforcing bar 130 and the mold 120, the textile grid 140 are fixedly disposed on the textile grid fixing device 200, the anchor 250 or 260 of the textile grid fixing device 200 is cut or disassembled, and the mold 120 is removed so that a cross section of the textile-reinforced concrete structure 100 may be completed. In this case, when a working space between the mold 120 and the reinforcing bar 130 is insufficient, the textile grid fixing device 200 is pre-fixed to one side of the mold in advance before the mold 120 is assembled, the textile grid 140 is assembled in the textile grid fixing device 200, and the mold 120 may be installed.

Specifically, in the textile-reinforced concrete structure 100 using a textile grid fixing device according to one embodiment of the present invention, when the concrete structure is constructed, a plurality of textile grid fixing devices 200 are fixed to one side of the mold 120, concrete is poured and cured while the textile grid 140 is fixedly disposed, the anchor 250 or 260 of the textile grid fixing device 200 is cut or disassembled, the mold 120 is removed, and thus a cross section of the textile-reinforced concrete structure 100 may be precisely completed.

Therefore, according to one embodiment of the present invention, when the concrete structure 10 is constructed, a plurality of textile grid fixing devices 200 are fixed to one side of the mold 120, concrete is poured and cured while the textile grid 140 is fixedly disposed, the anchor 250 or 260 of the textile grid fixing device 200 is cut or disassembled, and the mold 120 is removed, and thus a cross section of the textile-reinforced concrete structure 100 may be precisely completed.

Further, when a working space between the mold 120 and the reinforcing bar 130 is insufficient, the textile grid fixing device 200 is pre-fixed to one side of the mold before the mold 120 is assembled, the textile grid 140 is assembled in the textile grid fixing device 200, and the mold 120 may be installed.

[Method of Constructing a Textile-Reinforced Concrete Structure Using a Textile Grid Fixing Device]

Figure 9:
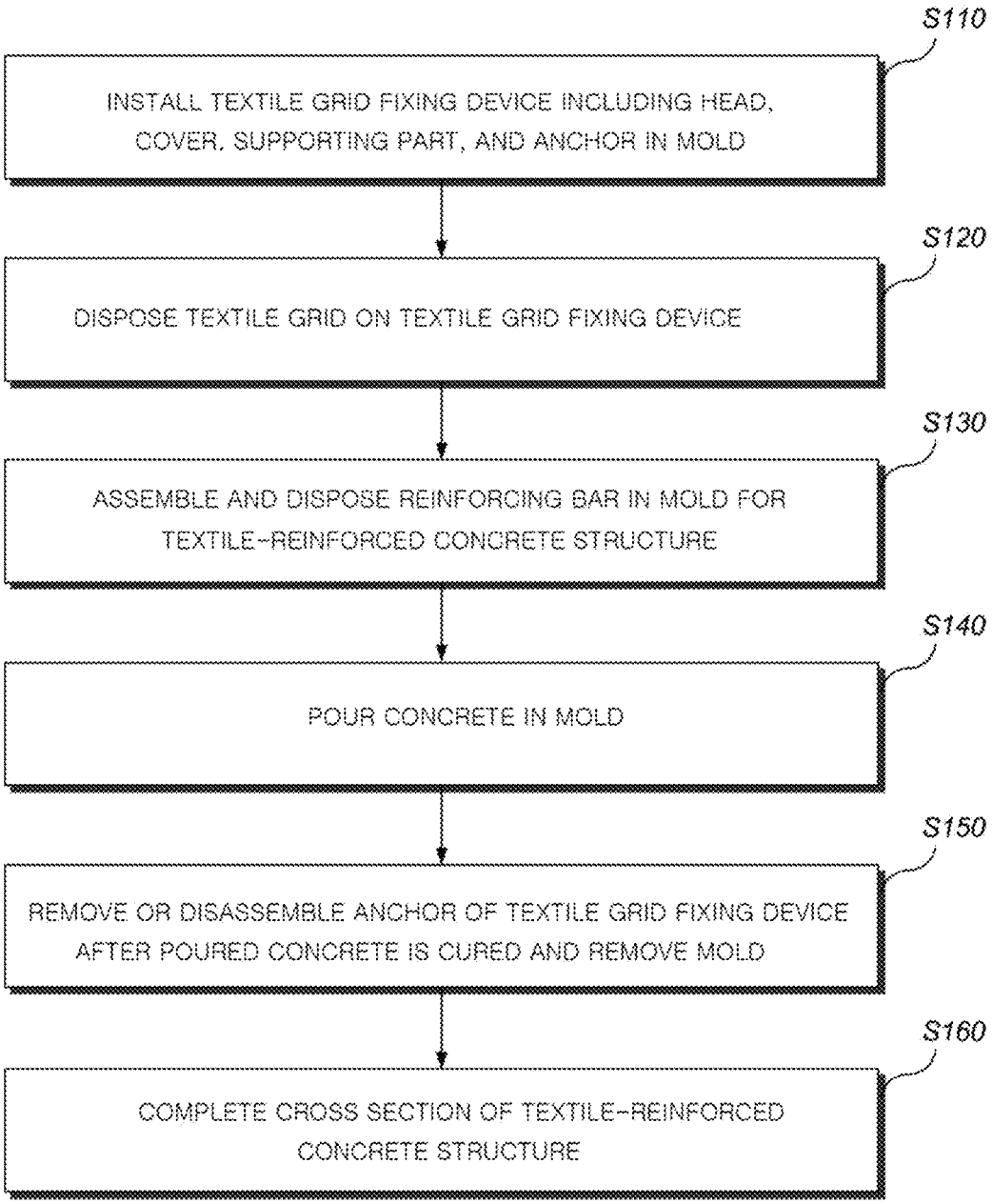
FIG. 9 is a process flowchart of a method of constructing a textile-reinforced concrete structure using a textile grid fixing device according to one embodiment of the present invention.

FIG. 9 is a process flowchart of a method of constructing a textile-reinforced concrete structure using a textile grid fixing device according to one embodiment of the present invention, and FIGS. 10A to 10F are cross-sectional views for specifically describing the method of constructing a textile-reinforced concrete structure using a textile grid fixing device according to one embodiment of the present invention.

Figure 10A:
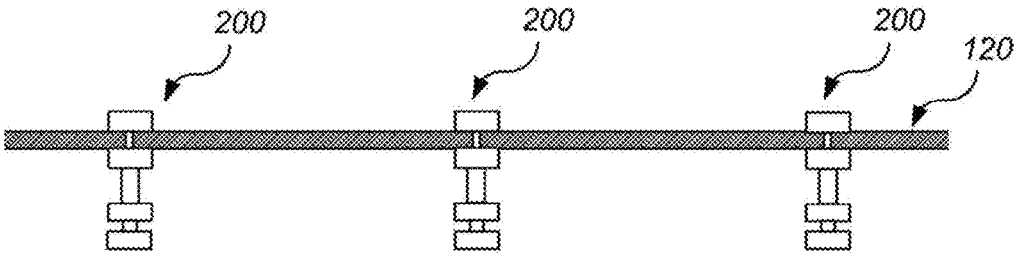
FIGS. 10A to 10F are cross-sectional views for specifically describing the method of constructing a textile-reinforced concrete structure using a textile grid fixing device according to one embodiment of the present invention.

Referring to FIG. 9, a method of constructing a textile-reinforced concrete structure using a textile grid fixing device according to one embodiment of the present invention is as follows. As shown in FIG. 10A, first, a textile grid fixing device 200 including a head 210, a cover 220, a supporting part 240, and an anchor 250 or 260 is installed (S110). Specifically, as shown in FIGS. 5 and 10A, the textile grid fixing device 200 may include the head 210 including a grip groove 211 and a head fastening hole 212, wherein a plurality of textile grids 140 are fixedly inserted into the grip groove 211; a cover 220 including a fastening anchor 221 and a grid insertion groove 222, wherein the fastening anchor 221 is fastened to the head fastening hole 212 while the plurality of textile grids 140 are disposed between the grip groove 211 and the grid insertion groove 222; an expansion joint 230 coupled between the head 210 and the supporting part 240 to adjust a height of the textile grid fixing device 200 according to spatial needs; the supporting part 240 fastened to a lower portion of the head 210 to function as a support; and an anchor 250 or 260 having one side fixed to the mold 120 and another side fastened to a lower portion of the supporting part 240 and cut or disassembled after the concrete is cured. In this case, the anchor 250 or 260 may be a bolt-type anchor 250 or a wedge-type anchor 260 as described above.

Figure 10B:
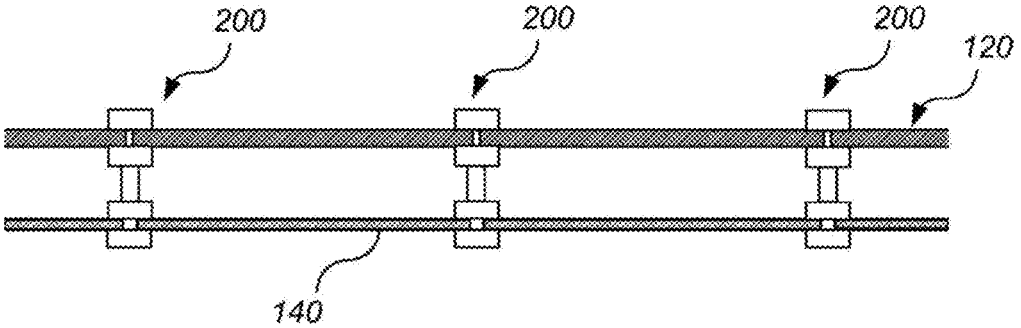

As shown in FIG. 10B, the textile grids 140 are fixedly disposed on the textile grid fixing device 200 (S120). In this case, the textile grid fixing device 200 is installed in a mold (120) and a connection part between the molds 120 or may be installed in a through hole formed at a predetermined position of the mold 120. Further, the textile grid fixing device 200 may minimally formed to support one end portion of the textile grid 140 and the connection part when the mold 120 and the anchor 250 or 260 is directly fastened to each other when a horizontal member, such as a slab, is constructed. In this case, the textile-reinforced concrete structure 100 is a concrete structure with a curved surface, such as tunnel lining or a wastewater structure, and may be precisely constructed by fixing the textile grid fixing device 200 to the mold 120 with a curved surface and fixedly disposing the textile grid 140 to be matched with the mold 120 having the curved surface.

Figure 10C:
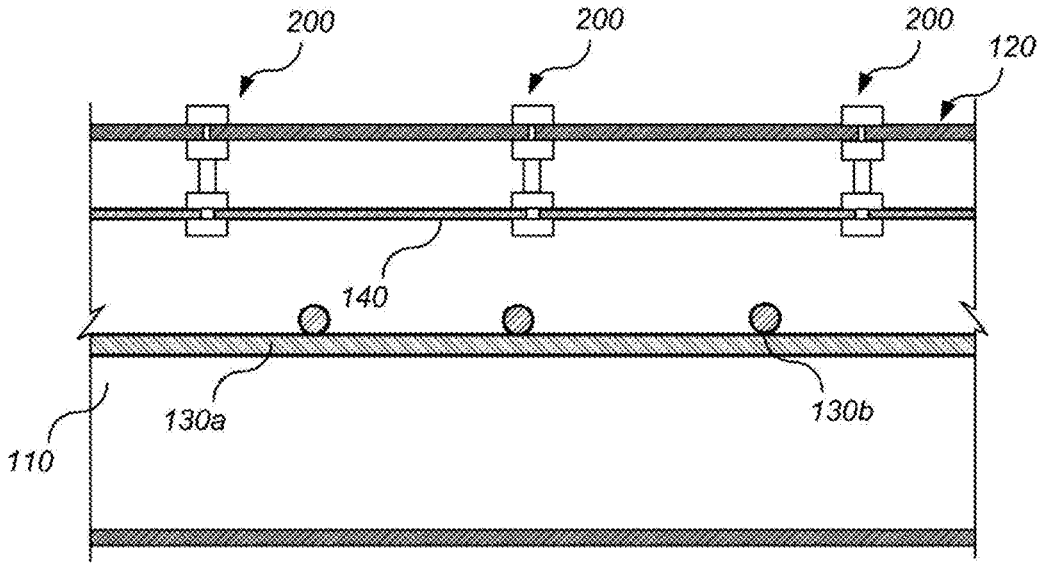

As shown in FIG. 10C, the reinforcing bar 130 is assembled and disposed in the mold 120 for the textile-reinforced concrete structure 100 (S130). In this case, the reinforcing bar 130 may be transversely and longitudinally embedded reinforcing bars 130*a* and 130*b* assembled and disposed in the mold 120.

Figure 10D:
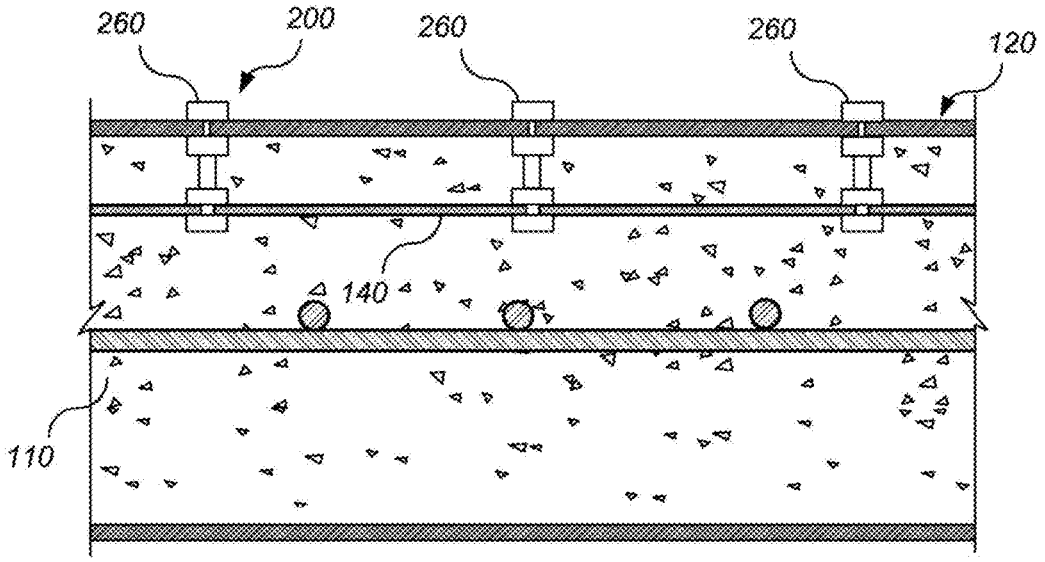

As shown in FIG. 10D, the poured concrete 110 may be poured in the mold 120 (S140).

Figure 10E:
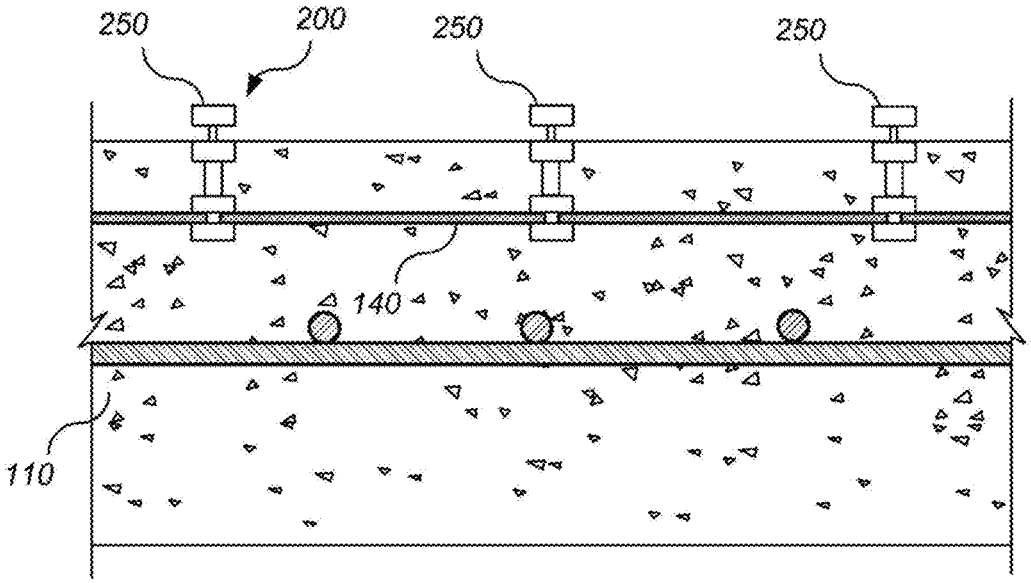

As shown in FIG. 10E, after the poured concrete 110 is cured, the anchor 250 or 260 of the textile grid fixing device 200 is removed or disassembled, and the mold 120 is removed (S150).

Figure 10F:
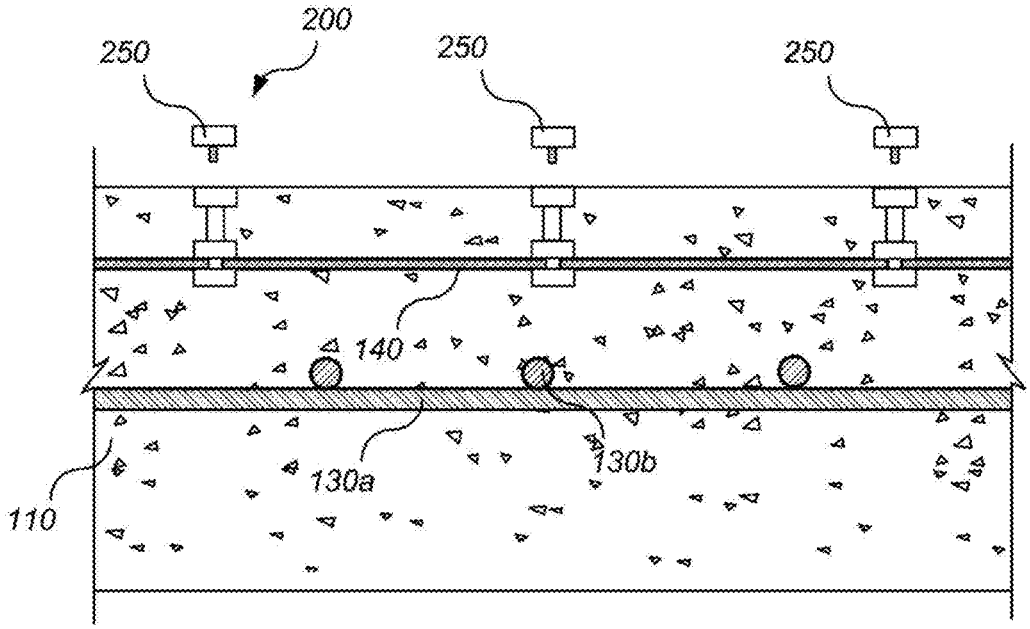

As shown in FIG. 10F, a cross section of the textile-reinforced concrete structure 100 is completed (S160). In other words, the textile grid fixing device 200 is fixed to one side of the mold 120 so that the plurality of textile grids 140 are fixed between the reinforcing bar 130 and the mold 120, the textile grids 140 are fixedly disposed on the textile grid fixing device 200, the anchor 250 or 260 of the textile grid fixing device 200 is cut or disassembled, and the mold 120 is removed, and thus a cross section of the textile-reinforced concrete structure 100 may be completed.

Accordingly, according to one embodiment of the present invention, a textile grid is precisely disposed at a predetermined position between a mold and a main reinforcing bar using a textile grid fixing device so as to be prevented from being moved by a pouring pressure when concrete is poured, and thus a textile-reinforced concrete structure can be precisely constructed.

According to one embodiment of the present invention, the textile grid fixing device is fixed to one side of the mold, and the textile-reinforced concrete structure is constructed using a textile grid fixing device so that fine cracks can be suppressed from being generated on a surface of concrete, and thus water, chloride, and the like can be prevented from permeating a concrete structure. Therefore, service lifetime of the textile-reinforced concrete structure can be extended, and safety thereof can be improved.

According to one embodiment of the present invention, a surface of the concrete structure is protected from an external environment when the textile-reinforced concrete structure is constructed so that a covering thickness of concrete is reduced, and thus the textile-reinforced concrete structure can be economically constructed.

According to the present invention, a textile grid is precisely disposed at a predetermined position between a mold and a main reinforcing bar using a textile grid fixing device so as to be prevented from being moved by a pouring pressure when concrete is poured, and thus a textile-reinforced concrete structure can be precisely constructed.

According to the present invention, the textile grid fixing device is fixed to one side of a mold, and a textile-reinforced concrete structure is constructed using the textile grid fixing device so that fine cracks are suppressed from being generated on a surface of concrete, and water, chloride, and the like are prevented from permeating the concrete structure, and thus service life of the textile-reinforced concrete structure can be extended, and safety can be improved.

According to the present invention, a surface of a concrete structure is protected from an external environment when a textile-reinforced concrete structure is constructed so that a covering thickness of concrete can be reduced, and thus, a textile-reinforced concrete structure can be economically constructed.

The above description is only exemplary, and it should be understood by those skilled in the art that the present invention may be performed in other concrete forms without changing the technological scope and essential features. Therefore, the above-described embodiments should be considered as only examples in all aspects and not for purposes of limitation. For example, each component described as a single type may be realized in a distributed manner, and similarly, components that are described as being distributed may be realized in a coupled manner.

The scope of the present invention is defined not by the detailed description but by the appended claims and encompasses all modifications or alterations derived from meanings, the scope, and equivalents of the appended claims.

What is claimed is:

1. A textile-reinforced concrete structure comprising:

poured concrete;

a reinforcing bar disposed in the poured concrete;

a plurality of textile grids installed between the reinforcing bar and a surface of the textile-reinforced concrete structure; and a textile grid fixing device including a head, a cover, and a supporting part, wherein the plurality of textile grids are fixedly disposed on the head, wherein a side of the textile grid fixing device away from the head is exposed at the surface, wherein the textile grid fixing device includes:

the head including a grip groove and a head fastening hole, wherein the plurality of textile grids are fixedly inserted into the grip groove;

the cover including a fastening anchor and a grid insertion groove, wherein the fastening anchor is fastened to the head fastening hole while the textile grids are disposed between the grip groove and the grid insertion groove; and the supporting part fastened to a lower portion of the head to function as a support.

2. The textile-reinforced concrete structure of claim 1, wherein the textile grid fixing device further includes an expansion joint coupled between the head and the supporting part so that a height of the textile grid fixing device is adjustable according to spatial needs.

3. The textile-reinforced concrete structure of claim 1, wherein the anchor is a bolt anchor or a wedge anchor.

4. The textile-reinforced concrete structure of claim 3, wherein the wedge anchor has a bolt thread formed on one side thereof and a wedge groove which is formed in another side thereof and into which a wedge is inserted so that the textile grid fixing device is fixed to one side of the mold in a wedge manner.

5. The textile-reinforced concrete structure of claim 1, wherein the grip groove formed in the head is formed to have a depth sufficient for two textile grids to be simultaneously inserted thereinto.

6. A method of constructing a textile-reinforced concrete structure, the method comprising steps of:

a) installing a textile grid fixing device, including a head, a cover, a supporting part, and an anchor, in a mold;

b) fixedly disposing a textile grid on the textile grid fixing device;

c) assembling and disposing a reinforcing bar in the mold, wherein the textile grid fixing device fixes the plurality of textile grids to one side of the mold so that the plurality of textile grids are fixed between the reinforcing bar and the mold;

d) pouring poured concrete in the mold;

e) removing or disassembling the anchor of the textile grid fixing device after the poured concrete is cured and removing the mold; and f) completing the textile-reinforced concrete structure, wherein the textile grid fixing device includes:

the head including a grip groove and a head fastening hole, wherein the plurality of textile grids are fixedly inserted into the grip groove;

the cover including a fastening anchor and a grid insertion groove, wherein the fastening anchor is fastened to the head fastening hole while the textile grid is disposed between the grip groove and the grid insertion groove; and the supporting part fastened to a lower portion of the head and configured to function as a support.

7. The method of claim 6, wherein the textile grid fixing device further includes an expansion joint coupled between the head and the supporting part so that a height of the textile grid fixing device is adjustable according to spatial needs.

8. The method of claim 6, wherein the anchor is a bolt anchor or a wedge anchor.

9. The method of claim 6, wherein the grip groove formed in the head is formed to have a depth sufficient for two textile grids to be simultaneously inserted thereinto.

10. The method of claim 6, wherein the textile grid fixing device in the step a) is installed on the mold and a connection part between the molds or in a through hole formed at a predetermined position of the mold.

11. The method of claim 6, wherein the textile-reinforced concrete structure is a concrete structure with a curved surface including tunnel lining or a wastewater structure, wherein the textile grid fixing device is fixed to the mold formed with a curved surface, the textile grid is fixedly disposed to correspond to the mold formed with the curved surface, and the textile-reinforced concrete structure is constructed.

* * * * *